United States Patent [19]

Targe

[11] 4,176,862

[45] Dec. 4, 1979

[54] READ-AWAY FLAP

[75] Inventor: David M. Targe, Woodbury, N.Y.

[73] Assignee: Newsday, Inc., Garden City, N.Y.

[21] Appl. No.: 933,110

[22] Filed: Aug. 11, 1978

[51] Int. Cl.[2] ..... B42D 15/00

[52] U.S. Cl. ..... 283/64; 281/4; 281/19 R; 281/45

[58] Field of Search ..... 281/4, 3, 19 R, 15 R, 281/20, 15 B, 29, 45; 283/64; 11/1 R, 1 CD, 3

[56] References Cited

U.S. PATENT DOCUMENTS

| | | | |
|---|---|---|---|
| 996,968 | 7/1911 | Broussaud | 281/19 R |
| 1,201,802 | 10/1916 | Cass | 281/4 |
| 1,809,876 | 6/1931 | Taylor | 281/29 X |
| 2,516,809 | 7/1950 | Soderberg | 281/19 R X |
| 3,275,316 | 9/1966 | Cleary, Jr. | 270/57 |

FOREIGN PATENT DOCUMENTS

| | | | |
|---|---|---|---|
| 19439 | of 1900 | United Kingdom | 281/20 |

*Primary Examiner*—Robert L. Spicer, Jr.
*Attorney, Agent, or Firm*—Christie, Parker & Hale

[57] ABSTRACT

A cover sheet is provided for a newspaper having a plurality of adjacent sheets of newsprint of equal width and length with a vertical fold and a horizontal fold intersecting the vertical fold. The cover sheet is equal in length to the adjacent sheets and slightly more than one-half the width of the adjacent sheets. A back portion of the cover sheet overlies and coincides completely with the back of the newspaper. A first fold in the cover sheet coincides with the vertical fold to form a front portion substantially narrower than the front portion of the newspaper. The front portion overlies a narrow band of the front of the newspaper along the vertical fold. A second fold in the cover sheet intersects the first fold and coincides with the horizontal fold. Printed material on the cover sheet is arranged transverse to the printed material on the newspaper.

3 Claims, 2 Drawing Figures

READ-AWAY FLAP

BACKGROUND OF THE INVENTION

This invention relates to carriers for printed material and, more particularly, to a newsprint component in the form of a newspaper cover sheet.

A typical broad sheet newspaper comprises a plurality of adjacent sheets of newsprint of equal length and width, with a vertical fold and a horizontal fold intersecting the vertical fold. Often the sheets are divided into sections. It is common to place inserts within and between the sections of the newspaper for the purpose of advertising and promotion, as disclosed in Cleary U.S. Pat. No. 3,275,316. Sections of the newspaper hold the insert in place but also mask its visibility while the newspaper is stacked, i.e., before it is disassembled.

SUMMARY OF THE INVENTION

The invention is a cover sheet for a broad sheet newspaper or newspaper section that is equal in length to the adjacent sheets of the newspaper and slightly more than one-half the width of the adjacent sheets of the newspaper. The back portion of the cover sheet overlies and coincides completely with the back of the newpaper. A first fold in the cover sheet coincides with the vertical fold of the newspaper to form a front portion substantially narrower than the front portion of the newspaper. The front portion of the cover sheet overlies a narrow band of the front of the newspaper along the vertical fold. A second fold of the cover sheet, called a read-away flap, coincides with the horizontal fold of the newspaper.

A feature of the invention is the arrangement of printing on the cover sheet transverse to the printing on the sheets of the newspaper.

The cover sheet provides a prominent position for advertising and promotional material or feature material. The printed material of the cover sheet stands out from the material of the newspaper proper by virtue of its transverse arrangement and prominent position, and is retained in place around the newspaper by the vertical and horizontal folds thereof, particularly the horizontal fold.

BRIEF DESCRIPTION OF THE DRAWING

The features of a specific embodiment of the best mode contemplated of carrying out the invention are illustrated in the drawing, in which.

DETAILED DESCRIPTION OF THE SPECIFIC EMBODIMENT

Figure 1:
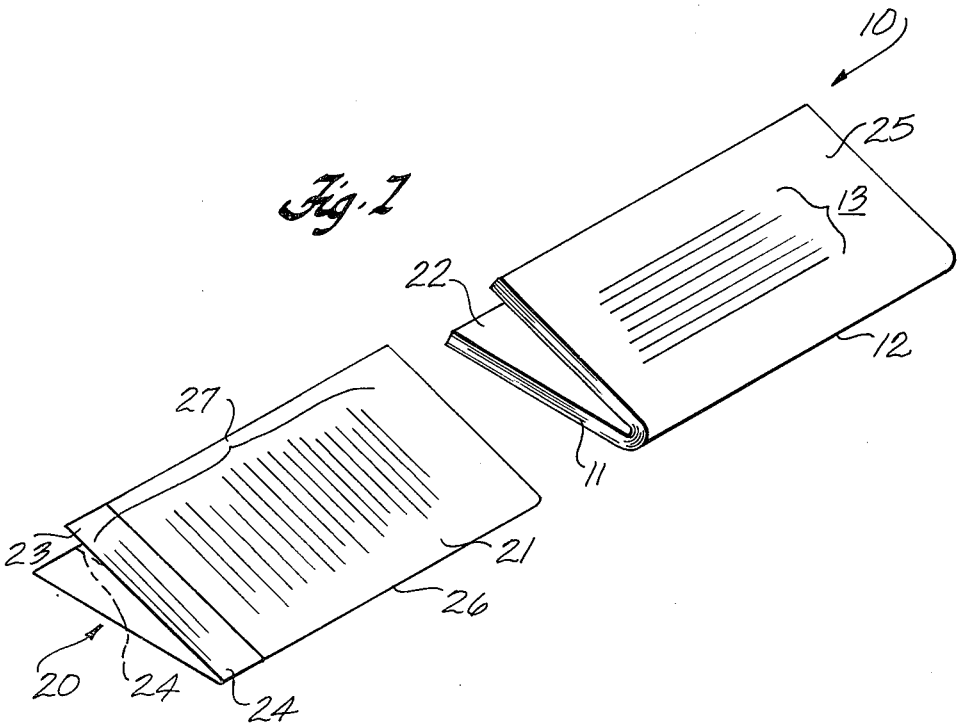
FIG. 1 is an exploded perspective view of a newspaper and a cover sheet therefor incorporating the principles of the invention.
Figure 2:
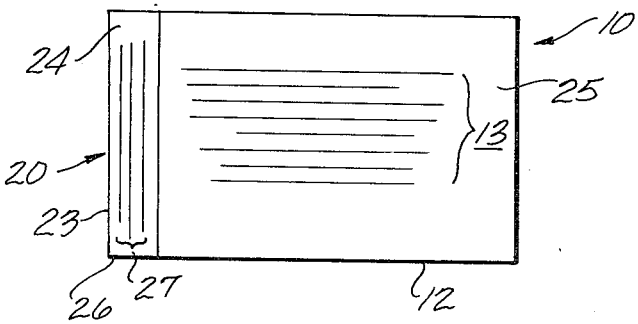
FIG. 2 is a side elevation view of the cover sheet and newspaper of FIG. 1 in assembled form.

In the drawing, a broad sheet newspaper or newspaper section 10 comprises a plurality of adjacent sheets of newsprint of equal length and width. A vertical fold 11 and a horizontal fold 12 that intersects vertical fold 11 are formed in the sheets of newspaper 10. The sheets of newspaper 10 bear printed matter 13 that is arranged perpendicular to fold 11 and parallel to fold 12. A cover sheet 20 made of newsprint is equal in length to the sheets of newspaper 10 and slightly more than one-half the width of the sheets of newspaper 10. Preferably, cover sheet 20 and the sheets of newspaper 10 are the same weight of paper. Cover sheet 20 has a back portion 21 overlying and coinciding completely with the back of newpaper 10, designated 22 in FIG. 1. A fold 23 in cover sheet 20 coincides with fold 11 to form a front portion 24 substantially narrower than the front of newspaper 10, designated 25. When cover sheet 20 is assembled as shown in FIG. 2, front portion 24 overlies a narrow band of the front of newspaper 10 along fold 11. Cover sheet 20 has a horizontal fold 26 intersecting fold 23 and coinciding with fold 12 of newspaper 10. Cover sheet 20 bears printed material 27 arranged parallel to fold 23, perpendicular to fold 26, and perpendicular to printed matter 13 on newspaper 10.

Cover sheet 20 provides a highly visible newsprint component on which advertising and promotional material or feature material may be printed. This printed material stands out from the material of the newspaper proper by virtue of its transverse arrangement and prominent position, and is retained in place around the newspaper by the vertical and horizontal folds thereof, particularly the horizontal fold.

In a typical embodiment, the sheets of newspaper 10 could have an unfolded length of 21½ inches and an unfolded width of 28 inches, resulting in a newspaper having a length of 10¾ inches and a width of 14 inches after the horizontal and vertical folds have been made. Cover sheet 20 could have an unfolded length of 21½ inches and an unfolded width of 16 inches, resulting in a folded cover sheet having a length of 10¾ inches and a front portion with a width of 2 inches.

The described embodiment of the invention is only considered to be preferred and illustrative of the inventive concept; the scope of the invention is not to be restricted to such embodiment. Various and numerous other arrangements may be devised by one skilled in the art without departing from the spirit and scope of this invention. For example, a tabloid newspaper section could be placed inside the broad sheet newspaper section, which has the described cover sheet.

What is claimed is:

1. In a broad sheet newspaper or newspaper section having a plurality of adjacent sheets of newsprint of equal length and width with a vertical fold and a horizontal fold intersecting the vertical fold, the improvement comprising a cover sheet of newsprint equal in length to the adjacent sheets and slightly more than one-half the width of the adjacent sheets, a back portion of the cover sheet overlying and coinciding completely with the back of the newspaper, a first fold in the cover sheet coinciding with the vertical fold to form a front portion substantially narrower than the front of the newspaper, the front portion overlying a narrow band of the front of the newspaper along the vertical fold, and a second fold in the cover sheet intersecting the first fold and coinciding with the horizontal fold.

2. The newspaper of claim 1, in which the plurality of adjacent sheets have printed matter arranged parallel to the horizontal fold, and the cover sheet has printed matter arranged parallel to the first fold.

3. The newspaper of claim 1, in which the cover sheet is of newsprint.

* * * * *